United States Patent [19]

Miller

[11] 4,304,657

[45] Dec. 8, 1981

[54] AROMATIZATION PROCESS

[75] Inventor: Stephen J. Miller, San Francisco, Calif.

[73] Assignee: Chevron Research Company, San Francisco, Calif.

[21] Appl. No.: 165,820

[22] Filed: Jul. 3, 1980

Related U.S. Application Data

[63] Continuation-in-part of Ser. No. 23,057, Mar. 22, 1979, abandoned.

[51] Int. Cl.[3] ..... C10G 35/06

[52] U.S. Cl. ..... 208/135; 208/134; 585/407; 585/415; 585/418

[58] Field of Search ..... 585/415, 418, 407; 208/135, 134

[56] References Cited

U.S. PATENT DOCUMENTS

| | | | |
|---|---|---|---|
| 3,775,501 | 11/1973 | Kaeding et al. | 585/415 |
| 4,035,285 | 7/1977 | Owen et al. | 585/407 |
| 4,090,949 | 5/1978 | Owen et al. | 585/415 |
| 4,157,356 | 6/1979 | Bulford et al. | 585/415 |

*Primary Examiner*—Curtis R. Davis

*Attorney, Agent, or Firm*—D. A. Newell; A. H. Uzzell; S. H. Roth

[57] ABSTRACT

An improved aromatization process is disclosed for upgrading the octane of an aliphatic feedstream, increasing the hydrogen to methane mol ratio of the product and decreasing the $C_{10}+$ aromatics production. In the process the feed is diluted with CO, $CO_2$ or $N_2$ at a mol ratio in the range of 1:1 to 1:20 of feed to diluent, and passed over a ZSM-5-type of aluminosilicate zeolite catalyst.

9 Claims, No Drawings

AROMATIZATION PROCESS

CROSS-REFERENCE TO RELATED APPLICATION

This application is a continuation-in-part of application Ser. No. 23,057, filed Mar. 22, 1979 and now abandoned.

FIELD OF THE INVENTION

This invention relates to an improved hydrocarbon conversion process for increasing the octane of aliphatic feedstreams. More particularly, the invention relates to an improved aromatization process for converting aliphatics to aromatics.

PRIOR ART

The importance of aromatics in the production and blending of high octane gasoline is well known in the art. Most refineries are accordingly equipped with reforming units for converting naphthenes and $C_6$+ paraffins to aromatic components.

Lower aliphatic hydrocarbons, such as those containing 2 to 5 carbon atoms per molecule, may also be converted to aromatics. The feedstock for the aromatics conversion may comprise single hydrocarbon species or mixtures thereof. Such conversions appear to be commercially attractive if the synthesis is catalyzed by certain crystalline aluminosilicate zeolites, known in the art as members of the ZSM-5 family. These catalysts permit the process to be conducted with aromatic yields greater than 30 weight percent based upon the nonaromatic feedstock. Members of the ZSM-5 family which appear to display significant aromatization activity include ZSM-5, ZSM-8, ZSM-11 and ZSM-12. These zeolites are more particularly described and methods for their manufacture are given in U.S. Pat. Nos. 3,702,886, 3,308,069, 3,709,979, and 3,832,449 respectively, which patents are incorporated herein by reference.

The general aromatization process is described and set forth in U.S. Pat. No. 3,756,942, which patent is incorporated herein by reference. According to the disclosure thereof, the preferred feed materials, boiling in the range from $C_5$ through 100° C., are contacted with a ZSM-5-type zeolite at a temperature of at least 343° C., a pressure in the range of 1 to 35 atmospheres, and a weight hour space velocity in the range from 1 to 15/Hr.

Preferably, the zeolites will have at least a portion of the original cations associated therewith replaced with other cations in accordance with known art techniques. Particularly effective aromatization catalysts include those members of the ZSM family which have been base-exchanged with hydrogen and/or zinc and/or cadmium.

It is also known in the art to disperse the zeolite catalyst in a porous matrix such as clay, alumina, silica and mixtures thereof. U.S. Pat. No. 3,843,741, incorporated herein by reference, discloses that high silica matrices are particularly preferred.

Zinc ZSM-5-type aromatization catalysts appear to be the most efficient catalysts for the conversion of aliphatics to aromatics. Unfortunately, the zinc ZSM-5 aromatization catalyst also produces fused ring aromatics, particularly naphthalenes. Naphthalenic products, however, tend to produce carburetor and/or engine deposits when used as a gasoline component and are thus undesirable. See U.S. Pat. No. 3,953,366.

Hydrogen is also produced in substantial quantities from the aromatization reaction in addition to $C_1$–$C_4$ paraffins and $C_2$–$C_4$ olefins. The hydrogen by-product may be combined with nitrogen for the production of ammonia or with carbon monoxide for the production of methanol or may be used in numerous refinery processes.

It is, therefore, an object of this invention to minimize the production of $C_{10}$+ aromatics and maximize the hydrogen production while maintaining high aromatic yields.

SUMMARY OF THE INVENTION

In accordance with this invention, there is provided in the process for converting an aliphatic feedstock to a product stream comprising aromatic hydrocarbons, hydrogen and methane by contacting said feedstock with an aromatization catalyst at a temperature in the range of 340° C. to 815° C. and a pressure in the range from one atmosphere to 35 atmospheres, the improvement which comprises: diluting said feedstock with a diluent selected from the group of diluents consisting of CO, $CO_2$ and nitrogen at a mol ratio of feedstock to a diluent ranging from 1:20 to 1:1.

The dilution provided by the present invention increases the hydrogen production, and decreases the production of $C_{10}$+ aromatics relative to processes in which the feedstream is not diluted.

Members of the ZSM-5 family, such as ZSM-5, ZSM-8, ZSM-11 and ZSM-12 are preferred for aromatization catalysts and the zinc exchanged ZSM-5 catalyst is particularly preferred. Other zeolites which may be used include TEA mordenite and ZSM-21 which have been appropriately treated in accordance with methods outlined in the prior art.

It is also preferred that the process be conducted at a temperature in the range of 480° C. to 540° C. and at a pressure of about one atmosphere.

DETAILED DESCRIPTION OF THE PREFERRED EMBODIMENT

In accordance with the present invention, hydrocarbon feedstock containing paraffins and/or olefins and/or naphthenes is diluted and contacted with an aromatization catalyst at a temperature in the range of 340° C. to 815° C. to produce commercial yields of aromatics.

The feedstock may comprise single hydrocarbon species, for example, propane, or may comprise a mixture of hydrocarbons, such as a light straight-run naphtha. Aromatics yields from olefins and naphthenes are generally higher than yields from paraffins, but the feedstock choice as dictated by refinery economics, will normally comprise feed materials of low octane value.

Since the primary function of the present invention involves octane upgrading by the conversion of feed aliphatics to aromatics, the inclusion of aromatics in the feed serves no useful purpose and should be avoided. The preferred feedstocks comprise aliphatic fractions boiling in the range from $C_2$ to 70° C. Typical refinery stock suitable for use in the process includes light straight run naphthas, coker gasolines, FCC gasoline and pyrolysis gasolines.

As used herein, the term "aromatization catalyst" is intended to include all known catalysts which are capable of producing commercially economic yields of aromatics from the aliphatic feedstocks described above.

Such catalysts include the ZSM-5-type of aluminosilicate zeolites which are capable of attaining aromatic yields of 30 weight percent or greater based upon the aliphatic portion of the feed. The ZSM-5-type zeolites are generally considered to include ZSM-5, ZSM-8, ZSM-11, ZSM-12 and other similarly behaving zeolites. The prior art has also observed that ZSM-21 and TEA mordenite are useful as aromatization catalysts if treated in accordance with the teachings of U.S. Pat. No. 3,890,218, which patent is incorporated herein by reference.

The zeolite may be combined, dispersed or otherwise admixed in a porous matrix or binder so that the final composite includes from 1 to 95 weight percent zeolite. The matrices which are suitable for use herein, include metals and alloys thereof, sintered metals, sintered glass, asbestos, silicon carbide, aggregates, pumice, diatomaceous earth, alumina and inorganic oxides. Inorganic compositions, especially those comprising alumina, and those of a siliceous nature, are preferred. Of these matrices, inorganic oxides such as clay, chemically treated clays, silica, silica alumina and alumina are particularly preferred because of their superior porosity, attrition resistance and stability.

Techniques for incorporating the zeolites into a matrix are conventional in the art and are set forth in U.S. Pat. No. 3,140,253.

Whenever the zeolites are used in combination with a porous matrix, space velocities which are set forth as parameters for the process are based upon the quantity of zeolite within the matrix and the amount of material comprising said matrix is ignored.

It is known in the art that zeolites, particularly synthetic zeolites, may have their compositions modified or altered by impregnating certain metals thereon or exchanging various anions and/or cations into the crystal structure of the zeolite.

The ZSM-5-type family of zeolites have been found to be especially active for aromatization if they have at least a portion of the original cations associated therewith replaced by other cations according to techniques well known in the art. Typical replacing cations would include hydrogen, ammonium and metal cations, including mixtures of same. Of the replacing cations, preference is given to cations of hydrogen, ammonium, cadmium, bismuth, tin, rare earths, magnesium, zinc, calcium, nickel and mixtures thereof. Particularly effective aromatization catalysts prepared from members of the ZSM-5-type family of zeolites are those which have been base-exchanged with hydrogen ions, zinc ions, cadmium ions or mixtures thereof.

Typical ion exchange techniques would involve contacting the zeolite with a salt of the desired replacing cation or cations. Although a wide variety of salts may be used, particular preference is given to chlorides, nitrates and sulfates.

The zeolite may also have the desired metallic component incorporated therein by techniques other than ion exchange. For example, the desired metals, such as zinc, copper, platinum or palladium may be impregnated thereon by conventional techniques as well as simply depositing the elemental metal onto the particular zeolite.

In accordance with the present invention, the aliphatic hydrocarbon feed is diluted with carbon dioxide, carbon monoxide or nitrogen prior to contact with the aromatization catalyst. Dilution should be made in the molar ratio of diluent to feed in the range from about 20:1 to 1:1. Preferred are dilutions of approximately 10:1 to 5:1 of diluent to feed. The dilution is observed to reduce the amount of $C_{10}+$ aromatics in the product and to increase the hydrogen to methane product ratio.

The aromatization reaction should be carried out at a temperature in the range of 340° C. to 815° C. preferably 425° C. to 650° C., and most preferably in the range of 480° C. to 540° C. Operational pressures range from 1 atmosphere to 35 atmospheres and preferred pressures range from 1 atmosphere to 10 atmospheres.

EXAMPLE I

A light straight-run Arabian naphtha having the characteristics given in Table I below, was contacted with a zinc-HZSM-5-type catalyst at 540° C. and atmospheric pressure.

TABLE I

| LSR NAPHTHA FEEDS | |
|---|---|
| Source | Arabian |
| Gravity, °API | 78.9 |
| N, ppm | <0.1 |
| S, ppm | <2 |
| RON, clear | 65.0 |
| P/N/A, Wt % | |
| P | 87.2 |
| N | 10.3 |
| A | 2.5 |
| Carbon No., Wt % | |
| $C_4$ | 0.5 |
| $C_5$ | 24.9 |
| $C_6$ | 60.7 |
| $C_7$ | 12.6 |
| $C_8$ | 1.3 |

The products of the aromatization process conducted without feed dilution and at 1:6 feed dilutions with nitrogen and carbon dioxide are shown in Table II below.

TABLE II

| CONVERSION OF LSR NAPHTHA OVER ZN-HZSM AT 540° C. AND ATMOSPHERIC PRESSURE | | | | | |
|---|---|---|---|---|---|
| Dilution | 0 | 0 | 1/6 | 1/6 | 1/6 |
| Diluent | | | $N_2$ | $N_2$ | $CO_2$ |
| LHSV | 4 | 2 | 2 | 2 | 2 |
| Contact Time, Sec. | 4.6 | 9.3 | 1.3 | 1.3 | 1.3 |
| $H_2/CH_4$, Mol Ratio | 3.6 | 3.2 | 4.2 | 4.2 | 4.9 |
| Yields, Wt % | | | | | |
| Methane | 5.1 | 6.6 | 6.1 | 4.9 | 3.9 |
| Aromatics | 46.2 | 53.0 | 51.8 | 48.9 | 39.4 |
| $C_{10}+$ | 1.6 | 1.5 | 0.4 | 0.3 | 0 |

As may be observed from Table II, dilution of the feed reduces the $C_{10}+$ aromatics production and increases the hydrogen to methane mol ratio in comparison with the undiluted feed conversions. A high hydrogen to methane mol ratio is desirable due to the difficulties encountered in separating hydrogen from methane for producing high purity hydrogen streams.

The presence of molecular oxygen in the diluent adversely affects the $H_2/CH_4$ ratio of the product stream. Accordingly, the diluent should be essentially free of molecular oxygen. Preferably, the diluent consists essentially of CO, $CO_2$, or $N_2$. The adverse effect or molecular oxygen is shown in Example II.

EXAMPLE II

A light straight run naphtha was contacted with a zinc-HZSM-5 type catalyst at 540° C., and atmospheric pressure, and the results are shown in Table III.

TABLE III

| | | |
|---|---|---|
| Dilution (Feed diluent) | ⅛ | ⅛ |
| Diluent | $N_2$ | Air |
| LHSV | 2 | 2 |
| Contact Time, Sec. | 0.7 | 0.7 |
| $H_2/CH_4$, Mol Ratio | 4.4 | 1.7 |
| Yields, Wt % | | |
| Methane | 3.4 | 11.4 |
| Aromatics | 20.6 | 30.7 |
| $C_{10}+$ | 0.8 | 1.0 |

What is claimed is:

1. A process for converting a feedstock selected from the group consisting of light straight run naphthas, coker gasolines, FCC gasolines, and pyrolysis gasolines to a product stream comprising aromatic hydrocarbons, hydrogen and methane comprising contacting said feedstock with an aromatization catalyst comprising a zinc HZSM-5 catalyst at a temperature in the range of 340° C. to 815° C. and a pressure in the range from 1 atmosphere to 35 atmospheres in the presence of a diluent essentially free of molecular oxygen, said diluent selected from the group consisting of $CO_2$ and $N_2$ at a mol ratio of feedstock to diluent ranging from 1:1 to 1:20.

2. A process as recited in claim 1 wherein said mol ratio of feedstock to diluent ranges from 1:5 to 1:10.

3. A process as recited in claim 1 wherein said mol ratio of feedstock to diluent is approximately 1:6.

4. A process as recited in claim 1 wherein said temperature is in the range from 480° C. to 540° C.

5. A process as recited in claim 1 wherein said process is conducted at a pressure of approximately one atmosphere.

6. A process for converting an aliphatic feedstock to a product stream comprising aromatic hydrocarbons, hydrogen, and methane comprising contacting said feedstock with an aromatization catalyst at a temperature in the range of 340° C. to 815° C. and a pressure in the range from 1 atmosphere to 35 atmospheres, in the presence of a diluent comprising $CO_2$ at a mol ratio of feedstock to diluent ranging from 1:1 to 1:20.

7. A process as recited in claim 6 wherein said aromatization catalyst comprises a zinc HZSM-5 catalyst.

8. A process as recited in claim 6, wherein the diluent consists essentially of $CO_2$.

9. A process as recited in claim 1, wherein the diluent is $CO_2$.

* * * * *